US006711835B1

(12) United States Patent
Militello

(10) Patent No.: US 6,711,835 B1
(45) Date of Patent: Mar. 30, 2004

(54) SHOE AND REPLACEABLE HEEL

(76) Inventor: John Militello, 2208 - 15th St., San Francisco, CA (US) 94114

( * ) Notice: Subject to any disclaimer, the term of this patent is extended or adjusted under 35 U.S.C. 154(b) by 0 days.

(21) Appl. No.: 10/215,974

(22) Filed: Aug. 8, 2002

(51) Int. Cl.[7] ..... A43B 21/36; A43B 21/47; A43B 21/52

(52) U.S. Cl. ..... 36/42; 36/36 R; 36/36 B

(58) Field of Search ..... 36/36 R, 36 A, 36/36 C, 36 B, 42, 102, 30 R, 103, 97, 51, 45

(56) References Cited

U.S. PATENT DOCUMENTS

| | | | | | |
|---|---|---|---|---|---|
| 26,712 | A | | 1/1860 | Shaw | |
| 65,247 | A | | 5/1867 | Loveland | |
| 570,830 | A | * | 11/1896 | Vandervoort | 36/36 R |
| 640,317 | A | | 1/1900 | Perry | |
| 769,157 | A | * | 9/1904 | Fischer | 36/36 A |
| 879,011 | A | | 2/1908 | Sedivi | |
| 1,044,222 | A | | 11/1912 | Wenk | |
| 1,215,080 | A | | 2/1917 | Thomson | |
| 1,426,019 | A | * | 8/1922 | Summerfield | 36/36 R |
| 1,550,516 | A | * | 8/1925 | Des Moineaux | 36/36 R |
| 1,604,826 | A | | 10/1926 | Hornicek | |
| 1,608,072 | A | | 11/1926 | Thatcher | |
| 1,645,187 | A | | 10/1927 | Ducheneau | |
| 1,888,617 | A | | 11/1932 | Bridi | |
| 1,888,765 | A | * | 11/1932 | Jassen et al. | 36/36 R |
| 2,233,250 | A | | 2/1941 | Easton | |
| 2,240,816 | A | | 5/1941 | Tweedie | |
| 2,252,404 | A | | 8/1941 | Mauser | |
| 2,258,265 | A | | 10/1941 | Schwartz | |
| 2,958,966 | A | | 11/1960 | Huberman | |
| 3,084,460 | A | | 4/1963 | Huberman | |
| 3,646,497 | A | | 2/1972 | Gillikin | |
| 4,214,384 | A | | 7/1980 | Gonzalez | |
| 4,610,100 | A | | 9/1986 | Rhodes | |
| 4,670,996 | A | | 6/1987 | Dill | |
| 4,736,531 | A | * | 4/1988 | Richard | 36/45 |
| 4,805,320 | A | | 2/1989 | Goldenberg et al. | |
| RE33,018 | E | * | 8/1989 | Ostrander | 36/102 |
| 4,858,339 | A | * | 8/1989 | Hayafuchi et al. | 36/45 |
| 4,219,946 | A | | 9/1989 | Baum | |
| 4,944,099 | A | * | 7/1990 | Davis | 36/97 |
| 5,025,574 | A | | 6/1991 | Lasher, III | |
| 5,058,290 | A | | 10/1991 | Koehl et al. | |
| 5,309,651 | A | | 5/1994 | Handel | |
| 5,347,730 | A | | 9/1994 | Colon | |
| 5,373,649 | A | | 12/1994 | Choi | |
| 5,410,820 | A | | 5/1995 | Goodman | |
| 5,419,060 | A | | 5/1995 | Choi | |
| 5,456,026 | A | | 10/1995 | Lewis | |
| 5,519,950 | A | | 5/1996 | Wang | |
| 5,765,296 | A | * | 6/1998 | Ludemann et al. | 36/97 |
| 6,279,251 | B1 | * | 8/2001 | Davis | 36/97 |

* cited by examiner

*Primary Examiner*—Anthony D. Stashick
(74) *Attorney, Agent, or Firm*—Fenwick & West LLP

(57) ABSTRACT

A shoe (100) includes a heel base (120) having a front surface (122); a plate (200) having a front portion (210) and a rear portion (220) adjoining at a angle (285) of less than 90 degrees; and at least one replaceable heel (500). The replaceable heel (500) has a slot (520) in which the rear portion (220) of the plate (200) may be inserted. The front portion (210) of the plate (200) is attached to the front surface (122) of the heel base (120) so the replaceable heel (500) can be slid on or off the rear portion (220) of the plate. In one embodiment, the sole (140) of the shoe (100) has one or more gaps (146, 142) to enable it to flex as heel height is changed. In one embodiment, the shoe's upper (160) has a flexible strip (180) to curtail the strain on the upper (160) caused by changing heel heights. In one embodiment, a sliding restraint (130) at the back of the shoe (100) prevents the heel (500) from slipping off during wear.

28 Claims, 4 Drawing Sheets

SHOE AND REPLACEABLE HEEL

BACKGROUND OF THE INVENTION

1. Field of the Invention

The present invention relates generally to the field of footwear, and more specifically to replaceable and interchangeable shoe heels.

2. Background Art

Some people carry an extra pair or two of shoes in their bags just so they can change shoe height or shoe style on the go. But because shoes are heavy and take up significant space, carrying them can be very inconvenient. A solution known in the art is the interchangeable, removable heel. Interchangeable, removable heels, or "replaceable heels," help people avoid cluttering their bags with shoes.

For example, if a person were headed out for the evening, she may want to wear flats on the street, and then change into high heels at the soirée. Replaceable heels enable the person to make that change without carrying a full extra pair of shoes. The person carries just the replaceable heels, which can be connected and disconnected from a single pair of shoes. Upon arrival at the soirée, the person removes the flat heels and attaches the high heels, placing the flat heels lightly in her bag.

The problem with known replaceable heels is that they are of complicated design and construction that renders their implementation too expensive and burdensome. Further, some replaceable heels can be attached or removed only with portable tools. There is a need for a simple, inexpensive replaceable heel and shoe construction that is simple to manufacture and easy to use without tools.

There are also undesirable side effects of using replaceable heels. When the heel on a rigid shoe is raised, the sole may leave the ground at a point near the ball of the foot (the "ball area" of the sole). A shoe not designed to compensate for adjustable heels will experience wear and tear caused by compressing the inner sole and stretching the outer sole as pressure is placed on the shoe by the ball of the foot. The shoe may even collapse under the weight of the wearer. What is needed is a shoe for replaceable heels with a sole that can flex with the differing stresses of heels of various heights while keeping the ball of the foot comfortably on the ground.

Also, using replaceable heels can crumple or over-extend a shoe's upper (the top part of a shoe above the sole). The taller the heels, the less the angle between the toes and the rest of the foot. When taller heels are used, the shoe's upper is forced into a more compact angle, which crumples the surface and negatively affects the shoe's appearance. When shorter heels are used, either the shoe's upper is stretched and potentially damaged or the upper refuses to stretch and the wearer's toes curl uncomfortably upwards. What is needed is a shoe with an upper that works in conjunction with replaceable heels to compress and extend as needed when heels are changed.

Finally, replaceable heels of the prior art have a tendency to come off during wear. Solutions to this conundrum have again involved intricate mechanisms that are expensive to manufacture. What is needed is simple mechanism for preventing the replaceable heel from coming off during wear.

DISCLOSURE OF INVENTION

The present invention provides for a shoe (100) and a replaceable heel (500) of simple design, manufacture and use. An angularly-bent metal plate (200) is attached to the base heel (120) of the shoe (100). A replaceable heel (500) with a slot (520) in its front is easily slid on or off the metal plate (200) without tools. This combined mechanism of the single bent plate (200) and the replaceable heel (500) with the simple slot (520) in its front is inexpensive to manufacture and easy to use without need for tools. The plate (200) is preferably elastic enough to be bent away from the sole (120) to attach the heel (500) and, once the heel (500) is attached, to attempt to return to its original position, thereby gripping the heel (500) against the sole (120).

In one embodiment, the sole (140) of the shoe of the present invention has one or more gaps (142, 146) to enable it to flex as heel height is changed. In one embodiment, the shoe's upper (160) has a flexible strip (180) to curtail the strain on the upper (160) caused by changing heel heights. In one embodiment, a sliding restraint (130) at the back of the shoe (100) prevents the heel (500) from slipping off during wear.

The features and advantages described in this summary and the following detailed description are not all-inclusive, and particularly, many additional features and advantages will be apparent to one of ordinary skill in the art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

BRIEF DESCRIPTION OF THE DRAWINGS

The figures depict a preferred embodiment of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF THE PREFERRED EMBODIMENTS

Figure 1:
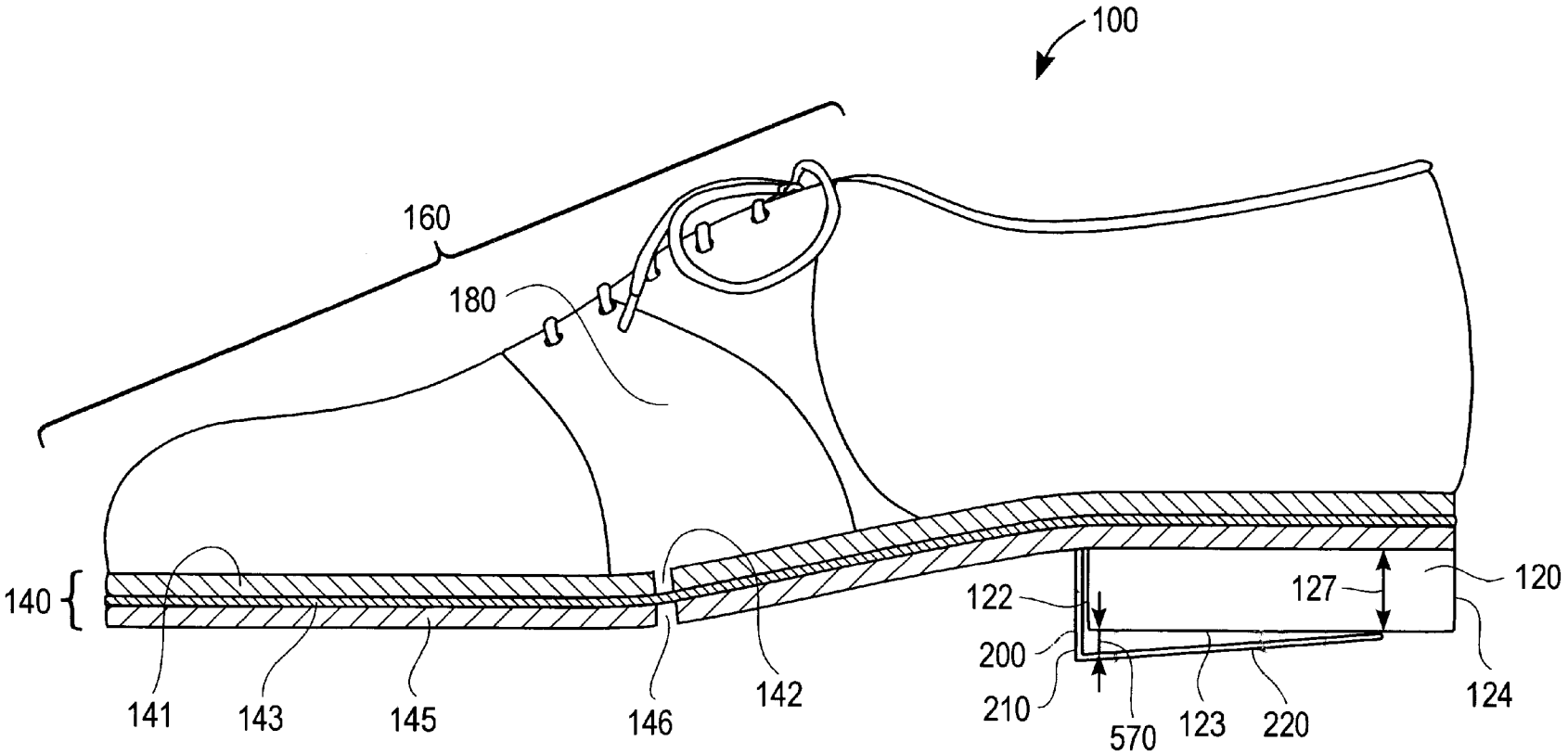
FIG. 1 is an illustration of a body shoe 100 with a plate 200 attached to a heel base 120.
Figure 2:
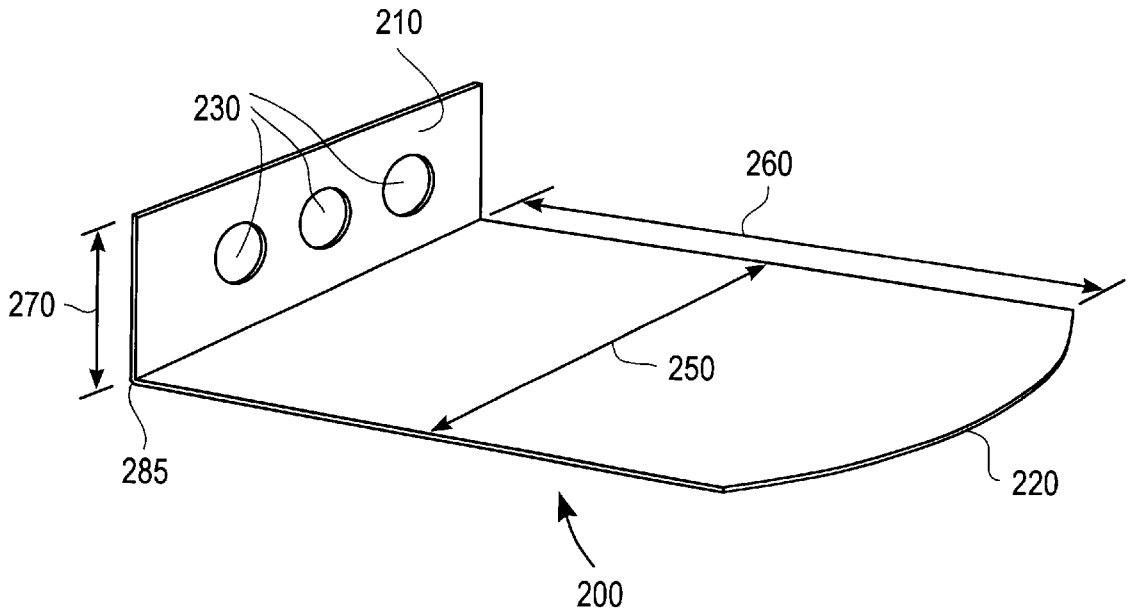
FIG. 2 is an illustration of a plate 200 that may be attached to a heel base of a shoe.
Figure 5:
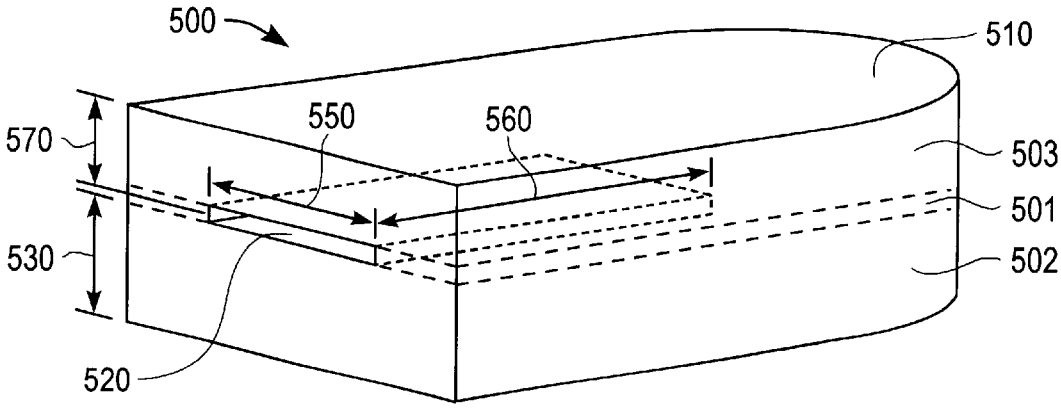
FIG. 5 illustrates a replaceable heel 500.

A shoe construction with a replaceable heel according to an embodiment of the present invention has three components: a body shoe 100, as illustrated in FIG. 1; a plate 200 as illustrated in FIG. 2; and a replaceable heel 500 as illustrated in FIG. 5.

The Body Shoe

FIG. 1 illustrates the body shoe 100 having an upper 160, which is attached to a sole 140, which is in turn attached to a heel base 120 of height 127. The body shoe 100 may be understood as any footwear including but not limited to a dress shoe, tennis shoe, casual wear, sandal, slipper, boot, skate, snowshoe, or thong. The upper may be of any style or material including but not limited to leather, rubber, straps, cloth, canvas or a combination thereof. The sole may be of any style or material including but not limited to leather, plastic, rope, rubber, or a combination thereof. In a preferred embodiment, the sole is a combination of leather and rubber. The heel base 120, preferably but not necessarily of the same material as the sole, has a front surface 122 and a rear surface 124, both substantially perpendicular to a bottom surface 123. The rear surface 124 may be flat or curved.

The Sole

In one embodiment, the sole 140 contains gaps that enable it to withstand stress produced by different sized heels. As seen in FIG. 1, sole 140 is made of three layers: inner sole 141, middle sole 143, and outer sole 145. Middle sole 143 is preferably made of flexible, water resistant material, such as a sheet of leather or rubber, and is interjacent to inner sole 141 and outer sole 145. Inner sole 141 and outer sole 145 are affixed to middle sole 143 and can be made of the same or different materials, including but not limited to leather, plastic, rope, rubber, or a combination thereof.

Both or either of inner sole 141 and outer sole 145 preferably have one or more gaps 142, 146, positioned so that the sole 140 may flex as the heel height is raised or lowered. Specifically, as higher heels are attached, inner gaps 142 contract and outer gaps 146 expand; as lower heels are attached, inner gaps 142 expand and outer gaps 146 contract. Thus the ball of the shoe can remain flat on the ground despite the changing height of the heel.

A preferred embodiment features a single ⅛" inner gap 142 and a single ⅛" outer gap 146, both proximal to the ball area of the sole 140, though multiple gaps of various sizes may be incorporated. In another embodiment, inner and outer gaps are located proximate to the front 122 of the heel base 120, another area of the sole that takes on significant stress when the height of the heel is altered. In another embodiment, the middle sole 143 and just one of the inner sole 141 or the outer sole 145 is used. It will be further recognized that additional layers of sole can be added, such as a thin layer above inner sole 141 to protect from pinching the foot.

A Flexible Upper

As illustrated in FIG. 1, in one embodiment, a portion of the upper 160 is formed with a flexible strip 180 in order to provide flexing to account for different height heels and prevent crinkling and folding at the bend of the toes (the portion of the upper adjacent to the metatarsal phalangeal joints). The flexible strip 180 spans the top of the shoe at or near the bend of the toes, and wraps around the upper (or spans at least a portion of the way across the upper from the inside to the outside of the foot). The strip 180 provides flexibility on the top of the body shoe 100. As higher or lower heels are attached, the flexible strip 180 accommodates the changes at the bend of the toe of the body shoe 100. The flexible strip may be of any flexible material, and may incorporate some degree of elasticity. In a preferred embodiment, the flexible strip is of a fashionable color and material.

The Plate

To grip a replaceable heel, an angled plate 200 is attached to the body shoe 100, preferably at a point adjacent to the front surface 122 of heel base 120. The plate 200 has a front portion 210 and a rear portion 220. The front portion 210 preferably extends substantially perpendicular to the sole 140 and extends beyond the heel base 120 approximately ½ inch 570. The rear portion 220 extends from the end of the front portion 210 towards the back of the shoe. The rear portion 220 is generally perpendicular to the front portion 210 and parallel to the sole 140. The rear portion 220 preferably has a slight angle towards the sole 140 in order to form a gripping relationship with a replaceable heel.

FIG. 2 illustrates further details of the plate 200. According to one embodiment, the plate 200 has a front portion 210 of height 270 and a rear portion 220 of width 250 and depth 260. Front portion 210 and rear portion 220 adjoin at a angle 285 of less than 90 degrees. The front portion 210 of the plate is preferably attached to the front surface 122 of the heel base 120. In a preferred embodiment, the front portion 210 of the plate includes one or more apertures 230 and is attached to the front surface 122 of the heel base 120 by screws, bolts, pins, anchors, staples, nails, rivets, etc. (generally referred to as "pointed platefixing means") extending through the apertures 230, or by glue, stitches, ties, solder, heat, fusing, etc. (generally referred to, with the pointed platefixing means, as "platefixing means").

Plate 200 is preferably made of metal, but may be of any material or combination of materials that (i) can be bent in manufacturing (for example, when heated) to stay at a specified angle, (ii) can flex with the application of force directed substantially perpendicular to the plane of the sole and away from the plate's original position as needed by a wearer to enable the attaching or detaching of a replaceable heel, and (iii) is elastic enough to exert force back toward the shoe in an attempt to recover its original position when so flexed to grip the replaceable heel in place. Plate 200 is preferably less than ⅛" thick and in one preferred embodiment is less than 1/16" thick.

The Replaceable Heel

FIG. 5 illustrates a detailed view of a replaceable heel manufactured according to a preferred construction. Replaceable heel 500 is preferably shaped as a rectangle with a convex curve in place of one side (the rear side). Heel 500 has a slot 520 at the front side (opposite the rear side) having a slot width 550 of preferably at least one inch and a slot depth 560 (running toward the rear side) of preferably at least 1.5 inches. Comparing FIG. 5 to FIG. 2, slot width 550 is preferably slightly wider than plate width 250, and slot depth 560 is preferably slightly deeper than plate depth 260, so that plate rear portion 220 can fit inside slot 520.

In a preferred embodiment, to construct a replaceable heel 500 with slot 520, the replaceable heel 500 is composed of three solid sections. Section A 501 of the replaceable heel, the middle section, is roughly "U"-shaped and preferably just slightly thicker than plate 200. Section A 501 defines the sides of the slot 520. Section C 503 is preferably shaped as a rectangle with a convex curve in place of its rear side (the side towards the rear of the shoe, which coincides with the curve of the "U" in section A). Section C 503 defines the top of the slot and is preferably but not necessarily solid and approximately ⅜" thick. The top of section B 502 defines the bottom of the slot and is preferably shaped as a rectangle with a convex curve in place of its rear side. The bottom of section B 502 is the section of the heel that comes in contact with the ground or other surface. Section B 502 may be of any shape (such as but not limited to tapered, stacked, western, pump, spiked or stiletto), any height 530 (from ⅛"

to 6" tall), and any feature or material (including but not limited to enameled, feathered, leather, wood, rubber, alligator, shock absorbing, roller, or tap).

The entire replaceable heel 500 may likewise be of any material or combination of materials. Such materials include but are not limited to rubber, plastic, wood, metal, and a combination thereof. Those skilled in the art will recognize that the replaceable heel with its slot 520 may be constructed by any means including but not limited to affixing sections one on top of the other, molding, carving, casting, or extruding.

Attaching the Heel

Figure 3:
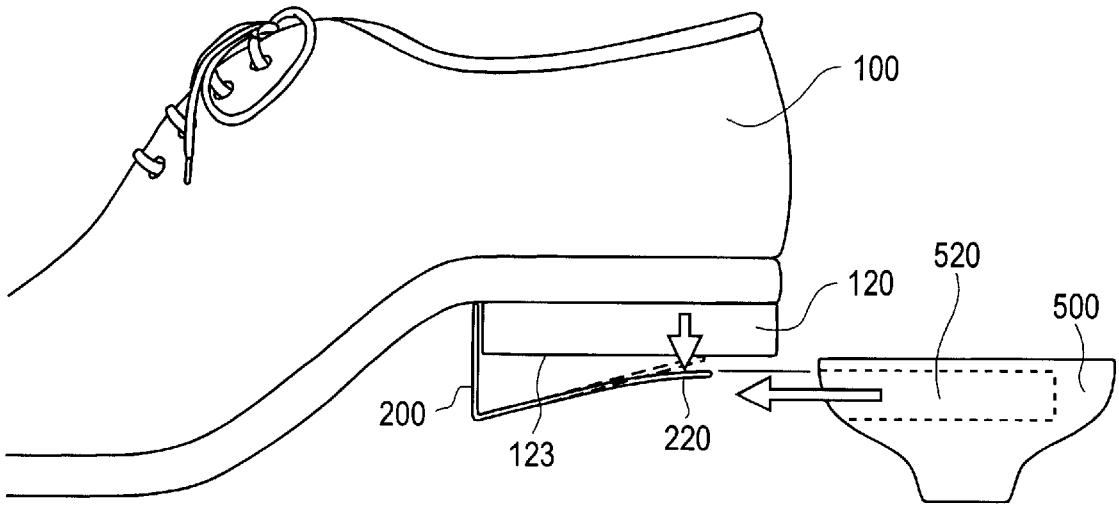
FIG. 3 illustrates attaching a replaceable heel 500 to a shoe 100 with a plate 200.

FIG. 3 illustrates attaching a replaceable heel 500 to a shoe with a plate 200 attached to its heel base 120. Plate rear portion 220, when flexed toward a perpendicular posture relative to plate front portion, preferably lines up with slot 520 to enable the plate 200 to be slidably inserted into the replaceable heel 500.

The plate rear portion 220 is slid into slot 520, which in turn snuggly sheaths the portion. When so attached, slot 520 runs parallel to bottom surface 123 of heel base 120. Two forces, one from the shoe and one from the wearer, preferably cooperate to keep the replaceable heel 500 from sliding off of the plate 200: the friction caused by the upwards force of the plate rear portion 220 on the top of the inside of the slot 520, and the forward force exerted on the heel 500 with every step taken by the Wearer of the shoe. Attaching and detaching a heel 500 from body shoe 100 takes just seconds, and no tools are needed. In a preferred embodiment, the replaceable heel 500 and the heel base 120 are designed to look as one single heel when the replaceable heel is attached.

Figure 4:
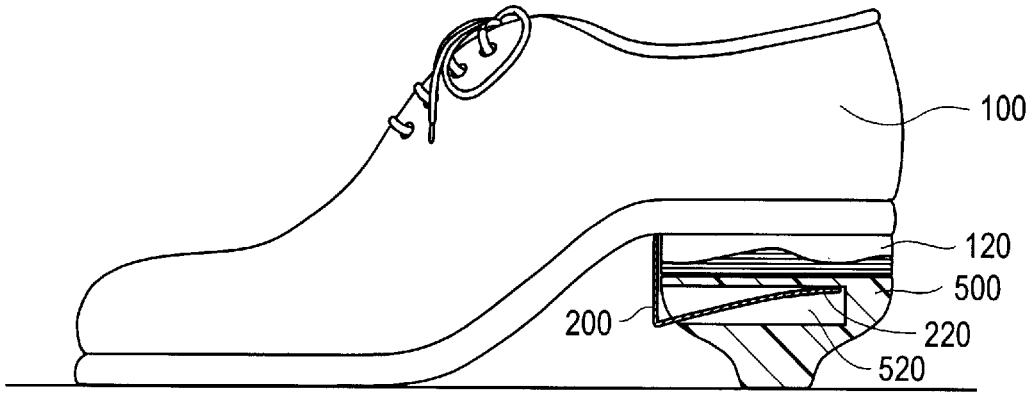
FIG. 4 is an illustration of a cross section of a shoe 100 with a replaceable heel 500 attached, the cross section illustrating the way the plate 200 applies upward pressure to hold the heel 500 firmly to the shoe 100.

FIG. 4 illustrates a cross section of a shoe with a replaceable heel attached, the cross section illustrating the way the plate 200 applies upward pressure to hold the attached heel firmly to the shoe. Plate rear portion 220 can be seen extending into slot 520 of replaceable heel 500. The plate's elasticity in combination with its angle 285 of less than 90 degrees advantageously allows the plate rear portion 220 to exert upwards pressure toward heel base 120 to grip the top of the inside of the slot 520 to hold the replaceable heel 500 firmly in place on the shoe 100.

The Sliding Restraint

Figure 6:
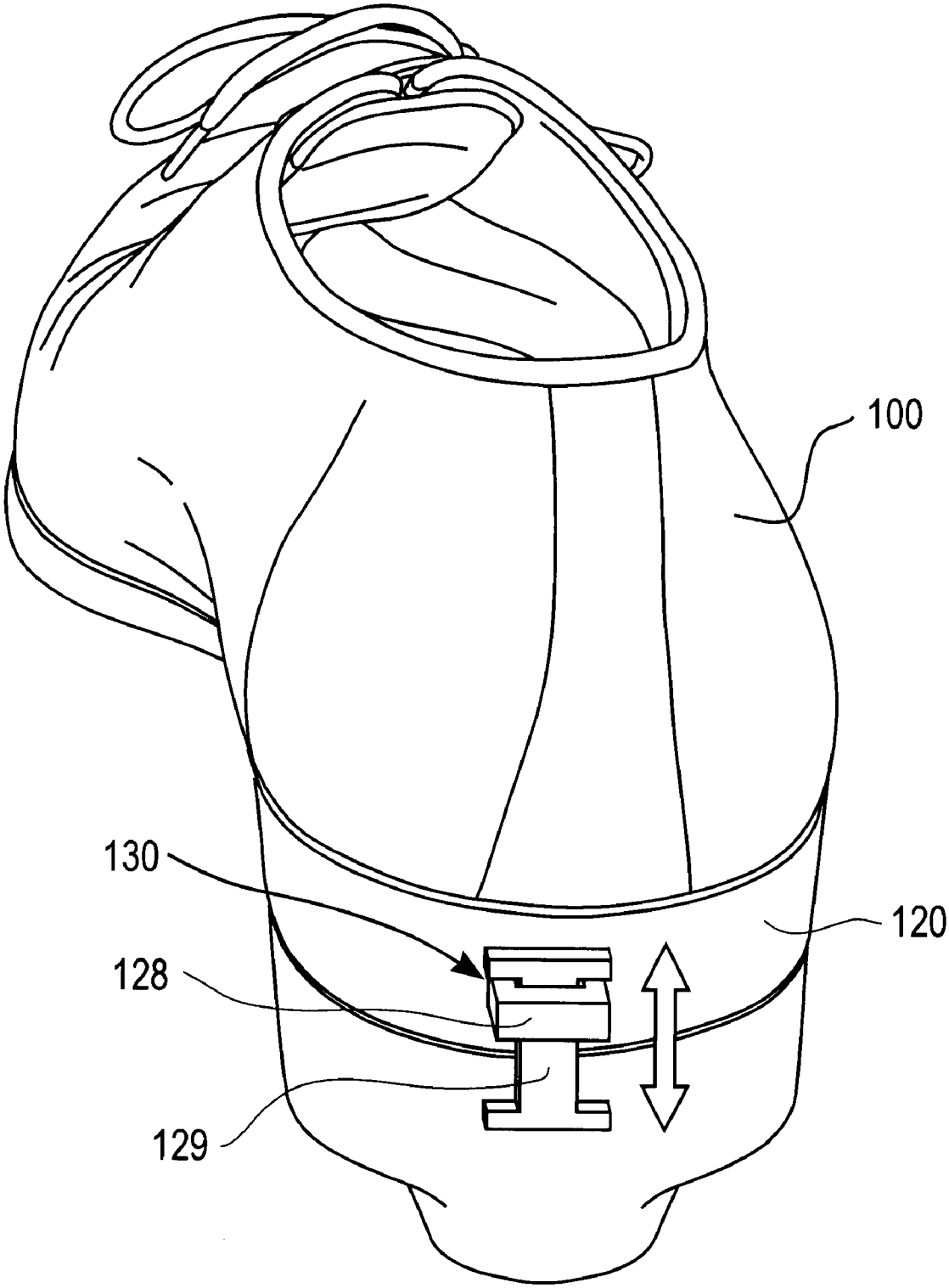
FIG. 6 is an illustration of a sliding restraint 130 on the back of a shoe 100.

In one embodiment, as illustrated in FIG. 6, a sliding restraint 130 supplies a third force to further ensure that the replaceable heel stays in place. The restraint 130 is preferably attached to the rear of the heel base 120. In one embodiment, the restraint 130 utilizes a key and keeper construction. A key 129, such as an I-beam or a dowel with bulbs on its top and bottom ends, is contained loosely by a roughly cylindrical or roughly U-shaped keeper 128 so as to enable upwards and downwards sliding of the key through the keeper 128. The keeper 128 is preferably affixed to the heel base 120. The keeper 128 is preferably long enough vertically or secured well enough to prevent the replaceable heel 500 from treating the key 129 as a lever to remove the keeper 128 from the heel base.

In use, the key 129 of the sliding restraint 130 slides down over the back end of the replaceable heel 500, and locks the heel into place so that it cannot slide backwards off of plate 200. When the shoe is worn, the sliding restraint 130 is preferably held in this securing position by the force of gravity. To remove the shoe, the wearer need merely slide the restraint upwards or turn the shoe upside-down before pulling the heel off of the plate. In an alternative embodiment, sliding restraint 130 may lock into place using mechanisms well known in the art.

The disclosure of the present invention is intended to be illustrative, but not limiting, of the scope of the invention, which is set forth in the following claims.

What is claimed is:

1. A shoe configured to accept a replaceable heel, the shoe comprising:

a sole having a ball area;

a heel base fixedly attached to the sole, the heel base having a front surface; and a plate having a substantially planar front portion and a substantially planar rear portion adjoining at an angle between of less than 90 degrees, the front portion of the plate fixedly attached to the front surface of the heel base, and the rear portion disposed to mate with and apply an upward gripping force on the replaceable heel.

2. The shoe of claim 1, wherein the front portion of the plate is fixedly attached to the front surface of the heel base by platefixing means.

3. The shoe of claim 2 wherein the plate is less than ⅛" thick.

4. The shoe of claim 2 wherein the plate is less than 1/16" thick.

5. The shoe of claim 1, wherein the front portion of the plate has at least one mating aperture adapted for the insertion of at least one pointed platefixing means, the pointed platefixing means extending through the mating apertures into the front surface of the heel base to fixedly attach the front surface of the place to the heel base.

6. The shoe of claim 1 wherein the upward gripping force is the primary force the shoe is configured to apply on the replaceable heel.

7. The shoe of claim 1, the sole further comprising:

at least one gap proximate to the ball area and disposed to allow flexing of the shoe about the ball area.

8. The shoe of claim 1 further comprising an upper attached to the sole opposite the heel base, the upper having a flexible strip adapted to enable the upper to flex responsive to a height of the replaceable heel.

9. The shoe of claim 1, wherein the sole further comprises:

an inner sole having at least one gap proximal to the ball area to enable flexing.

10. The shoe of claim 1, wherein the sole further comprises:

an outer sole having at least one gap proximal to the ball area to enable flexing.

11. The shoe of claim 1, wherein the sole further comprises:

an inner sole having at least one gap proximal to the ball area to enable flexing;

a flexible middle sole; and an outer sole having at least one gap proximal to the ball area to enable flexing.

12. The shoe of claim 11, wherein the middle sole is made of a waterproof material.

13. The shoe of claim 1 wherein the rear portion of the plate is adapted to insert into mating slots in a plurality of replaceable heels of varying height.

14. The shoe of claim 1 further comprising:

a sliding restraint fixedly attached to the heel base and configured to hold a replaceable heel in place on the shoe.

15. The shoe of claim 14, the sliding restraint further comprising:

a keeper affixed to the rear surface of the heel base, the keeper having an opening; and a key disposed to slide through the opening in the keeper to have a first position and a second position, the first position allowing detachment of the replaceable heel from the plate, the second position blocking detachment of the replaceable heel from the plate.

16. The shoe of claim 14 wherein the shoe is configured to hold the replaceable heel in place using primarily the upward gripping force and secondarily the sliding restraint.

17. A shoe with replaceable heel, said shoe comprising:

a sole;

a heel base fixedly attached to the sole, the heel base having a front surface; and a plate having a substantially planar front portion and a substantially planar rear portion adjoining at an angle between then of less than 90 degrees, the front portion of the plate fixedly attached to the front surface of the heel base, the rear portion applying an upward gripping force on the slot in a replaceable heel;

the replaceable heel comprising:

a top surface;

a front surface adjacent to the top surface;

a rear surface adjacent to the top surface; and a slot in the front surface below and substantially parallel to the top surface and extending toward the rear surface, the slot having a top and a bottom, wherein the slot sheaths and forms a gripping relationship with the plate.

18. The shoe of claim 17 wherein the plate is less than ⅛" thick.

19. The shoe of claim 17 wherein the plate is fixedly attached to the heel base by inserting at least one pointed platefixing means into at least one mating aperture in the front portion of the plate, the pointed platefixing means extending through the mating apertures into the front surface of the heel base.

20. The shoe of claim 17 wherein the plate is less than ⅛" thick.

21. The shoe of claim 17, the sole further comprising:

a ball area; and at least one gap proximate to the ball area and disposed to allow flexing of the shoe about the ball area.

22. The shoe of claim 21 further comprising an upper attached to the sole opposite the heel base, the upper having a flexible strip adapted to enable the upper to flex responsive to a height of the replaceable heel.

23. The shoe of claim 21, wherein the sole further comprises:

an inner sole having at least one gap proximal to the ball area to enable flexing.

24. The shoe of claim 21, wherein the sole further comprises:

an outer sole having at least one gap proximal to the ball area to enable flexing.

25. The shoe of claim 21, wherein the sole further comprises:

an inner sole having at least one gap proximal to the ball area to enable flexing;

a flexible middle sole; and, an outer sole having at least one gap proximal to the ball area to enable flexing.

26. The shoe of claim 25, wherein the middle sole is made of a waterproof material.

27. The shoe of claim 17 further comprising:

a sliding restraint fixedly attached to the heel base and configured to hold the replaceable heel in place on the shoe.

28. The shoe of claim 27, the sliding restraint further comprising:

a keeper affixed to the rear surface of the heel base, the keeper having an opening; and a key disposed to slide through the opening in the keeper to have a first position and a second position, the first position allowing detachment of the replaceable heel from the plate, the second position blocking detachment of the replaceable heel from the plate.

* * * * *

UNITED STATES PATENT AND TRADEMARK OFFICE

CERTIFICATE OF CORRECTION

PATENT NO. : 6,711,835 B1
DATED : March 30, 2004
INVENTOR(S) : John Militello

It is certified that error appears in the above-identified patent and that said Letters Patent is hereby corrected as shown below:

Column 6,
Line 14, insert -- them -- after “between” and before “of”;

Column 7,
Line 18, change “then” to -- them --.

Signed and Sealed this

Twenty-ninth Day of June, 2004

JON W. DUDAS
*Acting Director of the United States Patent and Trademark Office*